United States Patent [19]

Nagashima

[11] Patent Number: 4,597,469

[45] Date of Patent: Jul. 1, 1986

[54] COLLAPSIBLE HEADPHONE STRUCTURE

[75] Inventor: Mitsukatsu Nagashima, Tokyo, Japan

[73] Assignee: Pioneer Electronic Corporation, Tokyo, Japan

[21] Appl. No.: 714,487

[22] Filed: Mar. 21, 1985

[30] Foreign Application Priority Data

Mar. 22, 1984 [JP] Japan ..... 59-41111[U]

[51] Int. Cl.[4] ..... H04R 25/00

[52] U.S. Cl. ..... 181/129; 2/209; 179/156 R

[58] Field of Search ..... 181/129, 136, 137; 179/156 R, 149–151, 182 R; 2/6, 417, 424, 209

[56] References Cited

U.S. PATENT DOCUMENTS 1,395,864 11/1921 Pape ..... 179/156 R 1,699,127 1/1929 Wacker ..... 179/156 R

*Primary Examiner*—Benjamin R. Fuller

*Attorney, Agent, or Firm*—Finnegan, Henderson, Farabow, Garrett & Dunner

[57] ABSTRACT

A headphone structure comprises a pair of headband arms, a pair of phone units having joint arms, a first joint member for pivotally connecting the pair of headband arms, and a pair of second joint members for pivotally connecting the pair of phone units through their joint arms to the pair of headband arms, respectively. The headband arms and the phone units are collapsible via the first joint member and the second joint members. Rotational paths of the second joint members are included in a single plane. On the other hand, a rotational path of the first joint member is perpendicular to the single plane.

4 Claims, 6 Drawing Figures

COLLAPSIBLE HEADPHONE STRUCTURE

BACKGROUND OF THE INVENTION

This invention relates to a headphone for use with a small-sized cassette tape player, and more particularly to a headphone having a collapsible structure.

Recently, headphones for use with portable, small-sized cassette tape players are required to be smaller in size and lighter in weight than those intended for indoor use. In addition, the entire structure is required to be collapsible for each storing during non-use.

FIGS. 1(*a*) and 1(*b*) show a prior art headband having a collapsible structure. A pair of headband arms 1L and 1R, made of stainless steel, synethetic resin or the like are designed so that the headphone as a whole can be small in size and light in weight. One end of each heandband is pivotably coupled to a single joint member 2 as shown in FIG. 1(*b*). The joint member 2 has a U-shaped cross section. The headband arms 1L and 1R are each uni-directionally foldable through 90° around the pivot pins 6 from the fully open position of 180°.

Furthermore, the other free ends of the headband arms 1L and 1R are pivotably coupled to other joint members 3 which have the same structure as that of the joint member 2. Likewise, a pair of the phone units 4L and 4R are pivotably coupled to the other ends of these joint members 3. In addition, the headband arms 1L and 1R and the phone units 4L and 4R are foldable in a closed direction for easy storing when not in use (FIG. 2). In FIG. 2, reference characters 5L and 5R denote ear-contacting pads made of urethane or the like.

As has been apparent from the foregoing description, the following steps are required to collapse the prior art headphone for the storage: folding of the headband units 1L and 1R at the joint member 2, and further folding of the headband arms 1L and 1R around the joint members 3. In other words, three joint actions have been needed for the prior art foldable headphone. In some cases, the prior art headband foldable in the closed direction would cause unfavorable results of tangling or twisting upon the folding or opening operation due to the fact that the rotational paths of the arm members are included substantially in a single plane.

SUMMARY OF THE INVENTION

In view of these setbacks found in conventional headband structures, it is an object of the present invention to provide an easily collapsible headphone wherein folding actions may be simplified by improving the headband structure.

According to the present invention, there is provided a collapsible headphone structure comprising a pair of headband arms with the headband arms each being comprised of an upper and lower arm section. A pair of earphone units are each respectively affixed to one end of the lower arm section. A first joint member pivotally connects the pair of headband arms. A pair of second joint members pivotally connect the upper sections of the headband arms to the lower section of the headband arms and are foldable by means of the first and second joint members. The rotational plane of the arms in the first joint member is perpendicular to the rotational plane of the upper and lower sections in the second joint members.

DETAILED DESCRIPTION OF THE PREFERRED EMBODIMENTS

Figure 1A:
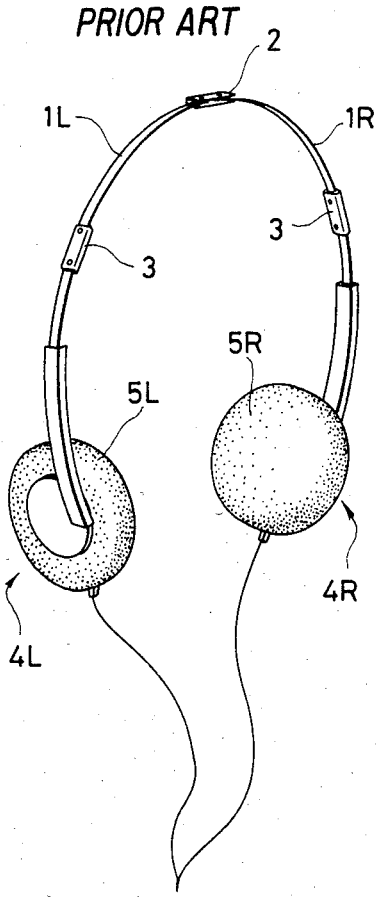
FIG. 1(a) PRIOR ART
FIGS. 1(*a*) and 1(*b*) are a perspective view of a conventional headband collapsible structure, and a view illustrating an operation of the primary part thereof.
Figure 1B:
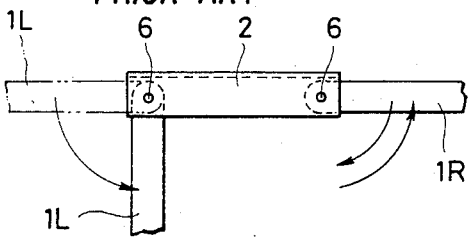
FIG. 1(b) PRIOR ART
Figure 2:
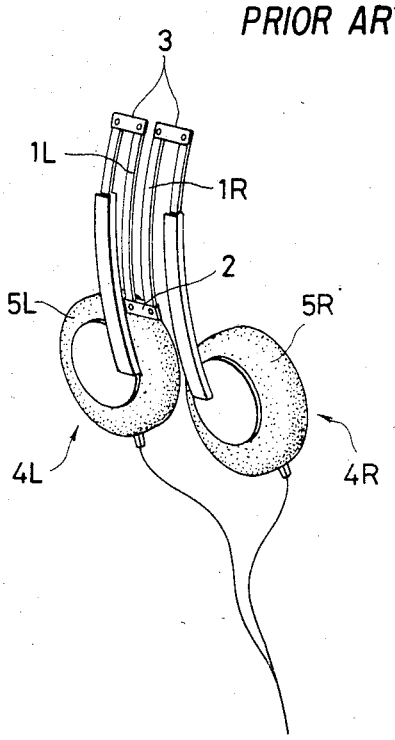
FIG. 2 PRIOR ART
FIG. 2 is a perspective view of the collapsed headphone structure while it is not in use.
Figure 3:
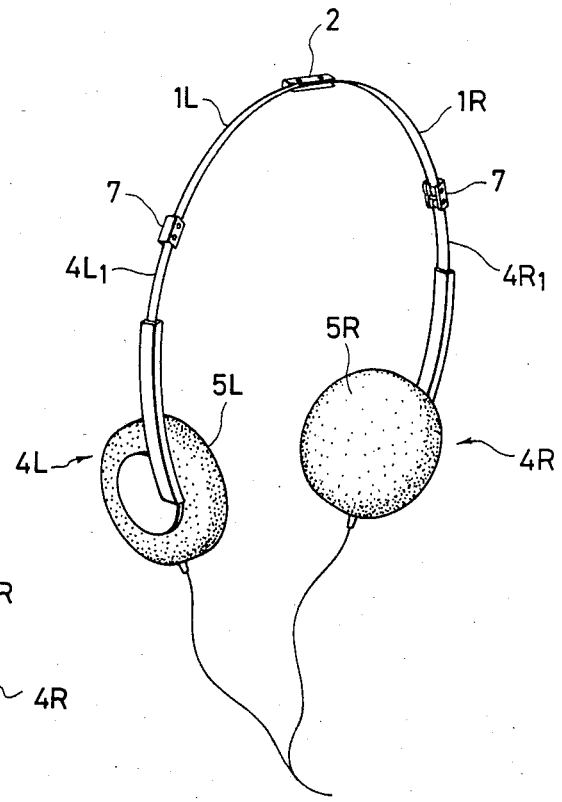
FIG. 3 is a perspective view of the headband in accordance with the embodiment of the invention.

An embodiment of the present invention will be described with reference to FIGS. 3, 4(*a*) and 4(*b*), in which the same reference characters are used to designate the same or like members or components in FIGS. 1(*a*), 1(*b*) and 2. According to the present invention, the first joint member 2 provided at the central part of the headphone is pivotably coupled to one end of each of headband arms 1L and 1R. This structure is the same as that shown in FIGS. 1(*a*), 1(*b*) and 2. The headband arms 1L and 1R unidirectionally foldable around pivot pins 6 at opposite ends of the first joint member 2 are known in the prior art. However, the swing or swivel angle thereof is not always limited to an angle of 90° for design needs in view of desired shapes and functions.

Figure 4A:
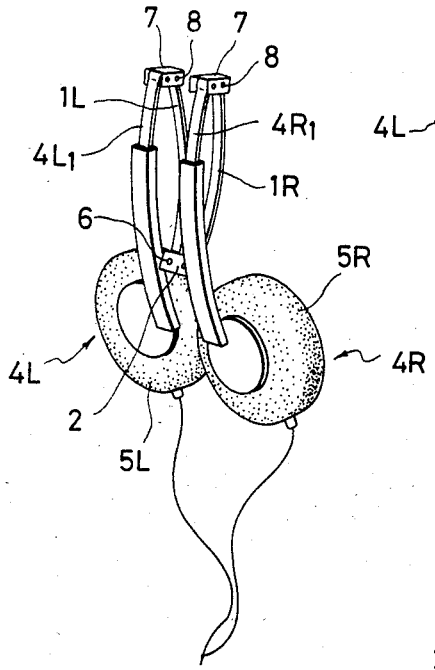
FIGS. 4(*a*) and 4(*b*) are a perspective view showing the headband collaspsible structure in accordance with the invention and a view illustrating the collapsing mechanism of the primary part thereof, respectively.
Figure 4B:
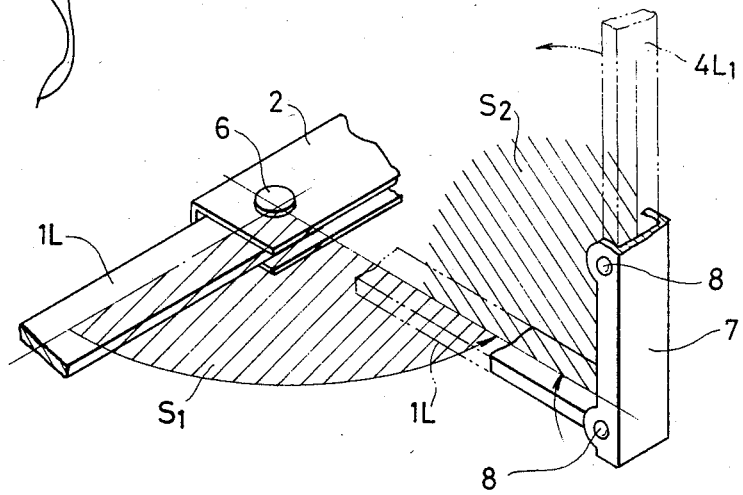

As shown in FIG. 4(*b*), the other end of the headband arm 1L and an associated coupling band 4L1 are pivotably coupled at pivot pins 8 to a second joint member 7. Assuming that the headband arm 1L is stationary, a rotational path of the first joint member 2 is perpendicular to a rotational path of the second joint member 7. In other words, the center lines of the pivot pins 6 and the pivot pins 8 form an angle of 90°. The hatched portions S1 and S2 as shown in FIG. 4(*b*) show a first plane defining the swing path formed by the headband arm 1L moving relative to the first coupling piece 2, and a second plane, vertical to the first plane, defining the swing path formed by the headband arm 1L moving relative to the second joint member 7. The overall headphone structure is constructed so that a pair of second joint members 7 are rotatable in a single plane to which the rotation path of the first joint member 2 is perpendicular.

Based on concepts discussed above, the same performance and effects can be expected by an arrangement that a collapsible structure causes to swing a pair of headband arms 1L and 1R in the downward direction around the first joint member 2. The performance and effects can be obtained by using the first joint member 2 having a shape similar to the second joint members 7 or otherwise by using the first joint member 2 in place of the second joint member 7.

The embodiment has a structure wherein two pins are used for pivotably coupling the first and second joint members 2 and 7 to the arm members. However, like performances and effects may be theoretically obtained in accordance with a coupling method where a single pivot pin is used as a common axis for connecting the pair of headband arms 1L and 1R.

In accordance with the invention, collapsing is completed by two joint operations by folding inside a pair of headband arms 1L and 1R around the first joint member 2, and then folding both headband arms around the second joint members 7.

As understood from the above, the headband can be collapsed quickly and easily by a simple action in accordance with the invention.

I claim:

1. A collapsible headphone structure comprising:

a pair of headband arms, each being comprised of an upper and a lower arm section; a pair of earphone units each respectively affixed to one end of said lower arm section; a first joint member for pivotally connecting said pair of headband arms; a pair of second joint members for pivotally connecting said upper sections of said headband arms to said lower sections of said headband arms; whereby said handband arms are foldable by means of said first and second joint members, wherein the rotational plane of said arms in said first joint is perpendicular to the rotational plane of said sections in said second joint members.

2. The structure of claim 1, wherein said first joint member and said second joint members each have a U-shaped cross-section.

3. The headphone of claim 2, wherein said first member and said second joint members have substantially the same in structure.

4. The headphone of claim 1, wherein said first joint member and said second joint members each have a pair of pivot pins.

* * * * *